US005908488A

United States Patent [19]

Schröder et al.

[11] Patent Number: 5,908,488

[45] Date of Patent: Jun. 1, 1999

[54] MAGNESIUM MELTING FURNACE AND METHOD FOR MELTING MAGNESIUM

[75] Inventors: Dominik Schröder, Halver, Germany; Erich Rauch, Gmunden, Austria

[73] Assignees: Schmitz + Apelt LOI Industrieofenanlagen GmbH, Germany; Rauch Fertigungstechnik Ges. m.h.H., Austria

[21] Appl. No.: 08/669,405

[22] PCT Filed: Sep. 27, 1995

[86] PCT No.: PCT/EP95/04232

§ 371 Date: Jul. 2, 1996

§ 102(e) Date: Jul. 2, 1996

[87] PCT Pub. No.: WO96/14439

PCT Pub. Date: May 17, 1995

[30] Foreign Application Priority Data

Nov. 3, 1994 [DE] Germany ..... 44 39 214

[51] Int. Cl.[6] ..... C22B 26/22

[52] U.S. Cl. ..... 75/386; 75/600; 75/601; 266/91; 266/207; 266/227; 266/239; 266/900; 266/901

[58] Field of Search ..... 75/600, 601, 602, 75/386; 266/215, 900, 901, 91, 207, 227, 239

[56] References Cited

U.S. PATENT DOCUMENTS

| | | | |
|---|---|---|---|
| 2,793,852 | 5/1957 | Harrison | 266/901 |
| 4,385,931 | 5/1983 | Wallevik et al. | 266/215 |
| 5,211,744 | 5/1993 | Areaux et al. | 266/901 |

*Primary Examiner*—Melvyn Andrews
*Attorney, Agent, or Firm*—Blakely, Sokoloff, Taylor & Zafman

[57] ABSTRACT

The magnesium melting furnace (1) has a plurality of chambers. The material to be melted is fed into a melting chamber (2) through a charging chute (20), one end of which terminates under the surface of the melting bath. The melt is slowly transferred into a holding chamber (4) through a passage (3) situated in the lower third of a dividing wall (11) above a layer of impurities settling at the bottom (14) of the melting chamber (2). The melt slowly flows through the holding chamber (4), with impurities rising to the surface or settling on the bottom (15). The purified melt flows through a second passage (5) situated in the lower third of a second dividing wall (12) into a metering chamber (6). The melt can be removed from the metering chamber (6) through a transfer pipe (28) using a metering pump (27). The magnesium melting furnace (1) makes it possible to simultaneously melt, purify and remove the magnesium in metered quantities.

24 Claims, 3 Drawing Sheets

MAGNESIUM MELTING FURNACE AND METHOD FOR MELTING MAGNESIUM

The present invention relates to a method for melting magnesium and a magnesium melting furnace with a first chamber to accommodate the melt and a device for feeding the material to be melted into the first chamber.

Magnesium is being increasingly used as a material, particularly for the manufacture of castings. Magnesium is, in a similar manner to aluminium, produced using an electrolysis process and is cast into bars, slugs or pigs which are melted in special melting furnaces before being further processed. During this process works scrap is added. The higher the share of works scrap is, the greater the contamination of the starting material being fed into the melting furnace is.

An arrangement for melting slugs and pigs and the further processing of molten magnesium is known from the DE 41 16 998 A1. Material to be melted is fed into a melting furnace via a refill orifice situated above the melt. The melt is withdrawn from the melting furnace below the surface of the melt via a siphon-like connecting line and passed into a casting furnace. The melt in the casting furnace serves as feedstock for further processing to castings. For further processing the molten magnesium is withdrawn from the casting furnace via a second siphon-like connecting line and fed into a casting die.

The disadvantage of this known plant is the high expense during commissioning owing to the use of two furnaces and the siphon-like connecting lines. The entire plant including the siphon-like connecting lines must be heated to above the melting point of magnesium so that a molten melt is present both in the casting furnace and in the melting furnace. The pressure in the casting furnace then has to be increased with a special pressure line so that the siphon-like connecting lines are completely filled with molten magnesium. Once the pressure has been reduced again, the melt levels in the two furnaces balance out so that when molten magnesium is removed from the casting furnace via the siphon-like connecting lines for further processing, magnesium from the melting furnace flows in to replace it.

The use of two separate furnaces is unfavourable as far as energy consumption is concerned and leads to relatively high construction costs.

Furthermore, such an arrangement does not permit the use of contaminated works scrap as the melt in the melting furnace must be relatively pure when it is withdrawn via the siphon-like connecting line as no further cleaning steps take place in the casting furnace.

It is the object of the present invention, to reduce energy losses during the melting of magnesium and the preparation of a purified melt whilst also reducing the construction costs.

The use of at least one second chamber makes it possible to combine the melting and purification of the melt in one melting furnace. As the melt is purified, it is possible to use a heavily contaminated starting material, for example a starting material with a higher old scrap content. Thanks to the special guidance of the flow of melt by suitable arrangement of the passage and outlet, a large part of the impurities can rise to the surface of the melt or sink to the bottom of the chambers, from where the impurities can easily be removed. Turbulences which are caused in the first chamber (melting chamber) by the immersion of the material to be melted and by the convection currents generated by the burners impair the settling or rising of impurities. This disadvantage is compensated for by the melt flowing over into the at least one second chamber (the holding chamber).

No turbulences occur in this chamber; the impurities can rise or settle. The arrangement of the passage and the arrangement of the outlet are selected in such a manner that as few impurities as possible are carried through with the flow.

Thanks to the flow guidance in the multiple-chamber furnace according to the present invention sufficient purification of the melt is possible without cleaning salts being added to the melting bath. Dispensing with the addition of salt means that the environmental impact is reduced and the high costs for the disposal of residues are avoided.

According to a preferred embodiment of the present invention a third chamber to accommodate the melt is provided downstream of the at least one outlet of the second chamber. The second and the third chamber have a common second dividing wall, the outlet from the second chamber being designed as a second passage in said second dividing wall. A device to remove the molten magnesium is connected to the third chamber. With this arrangement it is advantageous that a sufficiently purified melt is present in the third chamber which can be passed on directly for further processing. The third chamber thus contains a melt reservoir from which the magnesium can be removed batchwise.

In an advantageous embodiment of the present invention, the entire area of the at least one first passage is greater than an initial minimum area $A_{min,1}$. This minimum area is calculated from a maximum flow velocity of the melt in the passage with a given material throughput of molten magnesium through the magnesium melting furnace. The limiting of the flow velocity in the passage serves to avoid turbulences of the flowing melt at the passage. This prevents the entrainment of impurities, for example from the melt sludges at the bottom of the chamber. It is advantageous to limit the flow velocity to less than 0.1 m/sec. A significantly lower flow velocity is preferably selected by making sure that the passage is sufficiently wide.

In order to meet both the demands for the arrangement of the passage at a low point on the dividing wall (in the lower third of the dividing wall), for a sufficient distance of the passage from the settling melt sludge and for as large a cross-sectional area as possible, a preferred embodiment provides for the at least one first passage to be a gap stretching essentially over the entire width of the first dividing wall.

It is advantageous if the first and the second chamber exhibit an essentially rectangular basic area and the first dividing wall and the wall of the second chamber arranged downstream and exhibiting the outlet are arranged in one plane and parallel to each other. This simplifies the flow conditions in the second chamber and reduces the manufacturing cost of the melting furnace.

The second chamber must be sufficiently long in the direction of flow to ensure that the time during which the melt passes through the second chamber is sufficient for a large percentage of the impurities to settle on the bottom of the second chamber or rise to the surface of the melt.

In an advantageous embodiment of the present invention a middle wall ending with the bottom and the side walls is arranged in the second chamber between the first dividing wall and the wall exhibiting the outlet essentially in the middle between and parallel to said two walls, the height of said middle wall being greater than half the maximum filling level and smaller than the minimum filling level of the melt in the second chamber. Said middle wall diverts the flow in the second chamber so that even when the distance between the first dividing wall and the wall exhibiting the outlet is relatively short, i.e. even with a relatively short second chamber, the melt cannot flow directly between the first passage and the outlet. In a preferred embodiment the distances between the first dividing wall, the middle wall and the wall exhibiting the outlet as well as the height of the middle wall are selected so that in the second chamber a meander-shaped duct of essentially constant flow cross-section is formed through which the melt flows. In other embodiments further dividing and middle walls diverting the flow of the melt are conceivable. The flow conditions are influenced in such a manner that the settling or rising of impurities is improved.

Furthermore, it is possible to arrange a sink in the second chamber directly under the passage through which the melt enters from the first chamber. Gases are passed through the sink and the gases rising at the entrance to the second chamber improve the purification effect and the flow conditions in the second chamber.

In another advantageous embodiment of the present invention the total area of the at least one outlet is selected to be greater than a second minimum area $A_{min}$. The minimum area $A_{2,min}$ is calculated from a second maximum flow velocity $V_{max,2}$ of the melt in the outlet with a given material throughput of molten magnesium through the melting furnace according to the equation $$A_{\min,2} = \frac{\text{material throughtout of the melting furnace}}{\rho \cdot v_{\max,2}}$$

where ρ is the density of the molten magnesium. A maximum flow velocity of less than 0.05 m/sec. is preferably selected. Thanks to the selection of the low flow In an advantageous embodiment of the present invention the device for feeding material to be melted exhibits a charging chute, one end of which terminates under the melt surface in the first chamber. The material to be melted which is passed through this chute does not fall onto the melting bath surface and thus only entrains very few dross particles located on the inside surface of the charging chute into the bath. Furthermore the fact that the charging chute terminates under the melt surface means that it is possible to achieve more selective feed of the material to be melted with lower turbulence of the melting bath.

In an advantageous embodiment of the present invention the device for feeding the material to be melted exhibits a charging device which is coupled with a measuring device to measure the weight of the melting furnace so that the material to be melted is supplied as a function of the furnace weight. The mass of the material to be melted and which is fed into the furnace corresponds to the mass loss of the melting furnace through removal of the molten magnesium and/or removal of impurities (extraction of sludge from bottom of furnace). This keeps the filling level in the chambers more or less constant so that the end of the charging chute always terminates under the melt surface and the flow conditions in the chambers remain constant.

In a further advantageous embodiment of the present invention the device for feeding the material to be melted exhibits a burn-off device which is arranged in such a manner that the material to be passed into the first chamber can be thermally pre-treated when passing through the burn-off device, impurities being burned off and/or evaporated. The material to be melted, for example magnesium scrap contaminated with oil, is transported to the melting furnace on an enclosed conveying device. One section of the conveying device exhibits a heating facility in which the material is heated as it passes through, the impurities (e.g. oil residues) being burned off and/or evaporated. The gas forming (burned-off gas) is collected in the enclosure of the conveying device and can be passed on for further use. The heated material is fed to charging chute via locks and enters under the melting bath surface. The use of the burn-off device reduces the percentage of impurities in the material fed into the melting bath and therefore leads to less dross. Furthermore, it is not necessary to remove the burned-off reaction gases which would otherwise form over the melt in the first chamber. Therefore it is possible to use a higher percentage of works scrap and old scrap.

In an advantageous embodiment of the present invention the spaces in the first and second chambers and optionally also in the third chamber above the melt are isolated from each other by means of the first dividing wall respectively other dividing walls and can be separately filled with protective gas, it being possible to produce different protective gas compositions and concentrations in the spaces above the first and the second (and if appropriate the third) chamber. Thus it is possible to set the protective gas composition at the surface of the respective chambers as a function of the reaction parameters. To avoid oxidation reactions the protective gas normally contains a percentage of $SF_6$. The dividing of the spaces above the chambers makes it possible to have different $SF_6$ percentages above the melts in the chambers. In one preferred embodiment a protective gas in the space above the melt of the first chamber has a higher $SF_6$ percentage than the protective gas in the space above the melt in the second chamber. The $SF_6$ percentage is only selected to be relatively high (0.5%) where such a high concentration is necessary. Above the second chamber and optionally other chambers the $SF_6$ percentage is only 0.2 to 0.3%. This reduces the corrosive effects of the sulphuric acid forming from $SF_6$ in said chambers, which increases the service life of the melting furnace.

In a preferred embodiment the outer walls of the first and the second chamber are steel walls. Steel walls permit good heat transfer. It is advantageous to also design all chambers, dividing walls and partition walls as steel walls. The use of steel outer walls permits an arrangement of burners for the direct heating of the chamber via the outer walls of the first and the second chambers. It is also possible to use an electric resistance heating acting in the same manner.

In a preferred embodiment of the present invention the device to remove the molten magnesium exhibits a metering pump. With this metering pump it is possible to remove exactly the amount of magnesium required for further processing. The metering pump removes the necessary amount of molten and purified magnesium from the third chamber. In a preferred embodiment the metering pump is coupled with a transfer pipe through which the melt transported by the metering pump is removed from the side. In an advantageous embodiment the transfer pipe is also filled with protective gas. Rinsing of the transfer pipe with protective gas prevents oxidation of the magnesium removed. velocity of the melt in the outlet an entrainment of impurities from the second chamber and a passing of impurities into the third chamber is avoided. Furthermore, it is advantageous to arrange the lower limit of the at least one outlet at a height above the bottom of the second chamber which is greater than the maximum height of a layer of impurities, in particular heavy metal-containing melt sludges, settling on the bottom of the second chamber.

Particularly when the above-mentioned middle wall is provided in the second chamber is used, the outlet should be in the bottom section of the dividing wall to a third chamber. On the other hand, the outlet must be clearly above the maximum height of a layer of melt sludge settling on the bottom of the second chamber. The size of said outlet must also be sufficient to avoid too high a flow velocity and thus turbulences. In an advantageous embodiment of the present invention these requirements are met by the at least one outlet being a gap which stretches essentially over the entire width of the wall.

To improve the flow conditions in the second chamber an advantageous embodiment of the present invention exhibits a weir protruding horizontally into the second chamber on the upper edge of the gap forming the outlet.

In a preferred embodiment the bottoms of the first and the second chamber exhibit inclined surfaces which are arranged so that a channel is formed, at the lowest point of which impurities sinking in the melt, in particular heavy metal-containing melt sludges, collect. This concentration of impurities at certain points on the chamber bottoms permits simple removal. Advantageously a first and a second suction device are arranged in the first chamber respectively in the second chamber so that the impurities which have sunk to the bottom can be extracted by suction at the lowest point of the chamber floors. Thus the maximum height of the melt sludges in the melt chambers can be kept low which permits a lower positioning of the passages and thus leads to better utilisation of the chamber volume. The channel can be formed both by flat floor plates inclined against each other and by an arching of the floors. The suction device can be both a pipe introduced into the melt from above and an outlet mounted on the bottom of the chamber from below.

The material to be melted is preferably heated in the burn-off device to a temperature of approx. 300° C. to 450° C.

In a preferred embodiment the burned-off gases forming in the burn-off device are collected and either passed to a burner to heat the material to be melted in the burn-off device (indirect heating; radiant tubes) or to a burner to melt the material. Alternatively, the collected burned-off gases can be passed to a burner coupled with a heat exchanger, the heat exchanger serving to preheat the combustion air.

Advantageous embodiments of the present invention are characterised in the sub-claims.

The present invention is now described in greater detail in the following with the aid of the embodiments shown in the drawings, in which.

Figure 1:
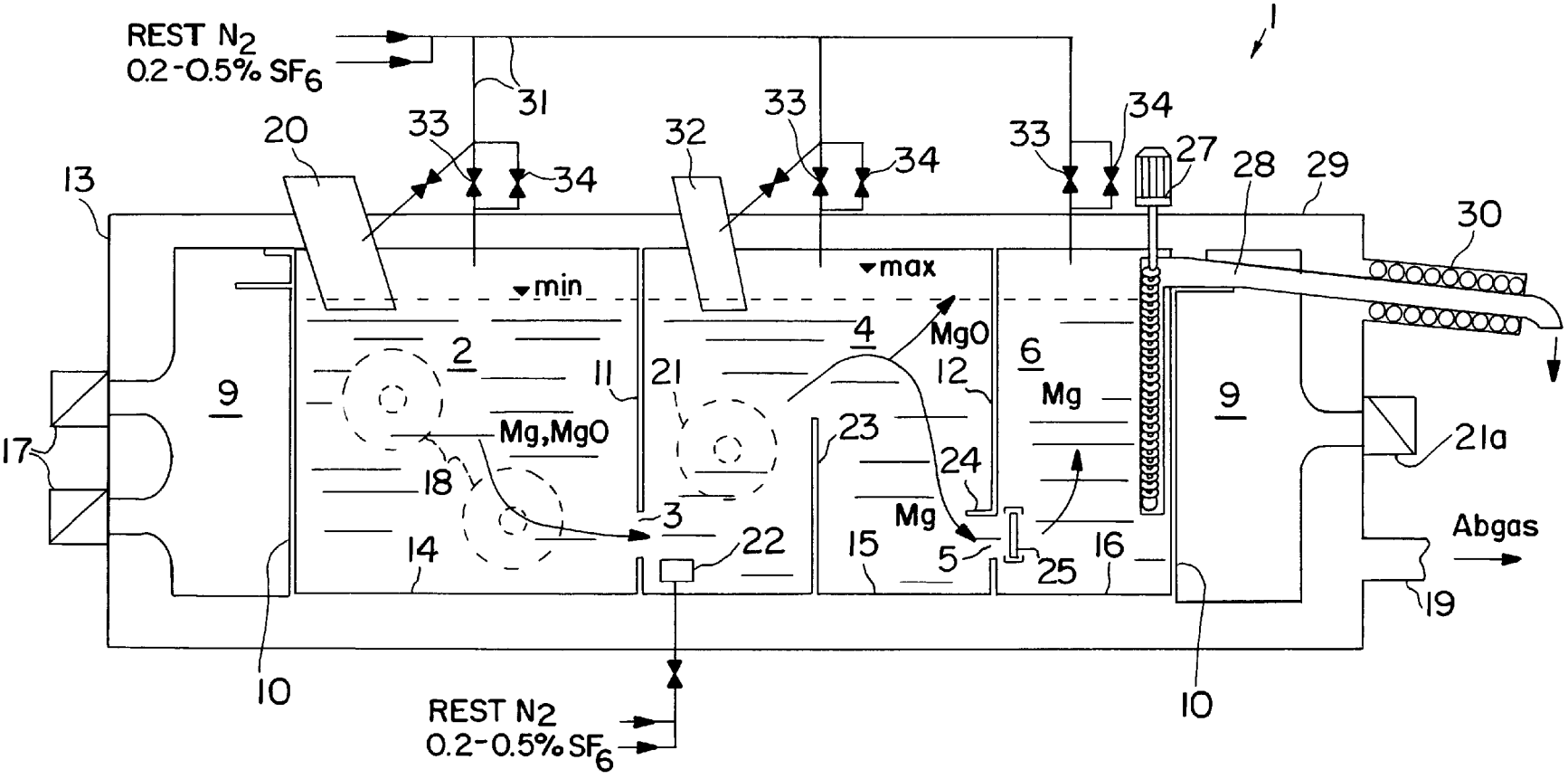
FIG. 1 is a preferred embodiment of the magnesium melting furnace according to the present invention.

FIG. 1 shows a magnesium-melting furnace 1 according to the present invention with three chambers, which permit melting, purification and removal of the magnesium in metered quantities. The material to be melted is passed into a first chamber, the melting chamber 2. The molten magnesium passes through a passage 3 into a second chamber, the holding chamber 4, in which the impurities can rise or sink during the residence period of the molten magnesium in said chamber. The purified molten magnesium passes through a second passage 5 entering a metering chamber 6, in which it is kept ready for removal.

The chambers 2, 4 and 6 of the magnesium melting furnace 1 are surrounded by steel walls 10. The steel walls guarantee relatively good heat transfer. A first dividing wall 11 is arranged between the melting chamber 2 and the holding chamber 4 and a second dividing wall 12 between the holding chamber 4 and the metering chamber 6. The first and the second dividing wall 11 and 12 are also made of steel. The three chambers are surrounded by a heat-insulating jacket 13. The floors 14, 15 and 16 of the three chambers rest on the jacket 13 whilst a combustion chamber 9 is formed between the side walls 10 of the chambers and the sides of the jackets 13. It is also conceivable to have an arrangement in which the furnace chambers are placed on a steel structure so that heating of the steel walls from below is possible. To heat the melting chamber 2 the front wall and the two side outer walls are each provided with two burners 17 and 18 in the jacket 13 in such a manner that their flames and the heat radiation of the burners are directed towards the outer wall 10 of the melting chamber 2. The burners 17 heat the front wall of the melting chamber 2 and the burners 18 the side walls. Another burner 21 is arranged on each side wall of the holding chamber 4, said burner additionally heating the melt in the holding chamber 4. In addition, a burner 21 a may be provided to heat the metering chamber 6. Said burner 21*a* serves in particular to additionally heat the melt to be removed in chamber 6 when the burners 17, 18 and 21 are not burning because no material is being fed in and melted. In other embodiments the number, size and distribution of the burners can be varied.

The hot waste gases introduced by the burners 17, 18, 21 and 21*a* into the combustion chamber 9 flow along the outer walls 10 to the waste gas outlet 19 which is arranged in the jacket 13 downstream of the metering chamber 6. When the furnace chambers are arranged on a steel structure, the waste gases could also be extracted by suction from below the chambers. This could provide an additional heating area and therefore melting capacity.

The material to be melted is fed into the melting chamber 2 via a charging chute 20. The bottom end of the charging chute 20 terminates under the surface of the melt in the melting chamber 2.

The material immersing into the melt of the melting chamber 2 is melted, impurities being absorbed into the melt. Some of the impurities, in particular heavy metal-containing melt sludges, sink to the bottom 14 of the melting chamber 2. Other impurities, in particular magnesium oxide, rise to the surface of the melt.

Contaminants in the form of dross collect on the surface of the melting bath. The melt flows through the first passage 3 to the holding chamber 4. The first passage 3 is formed as a horizontal gap in the first dividing wall 11. The lower edge of the gap 3 is at a sufficient height above the layer of impurities settling on the bottom 14 of the melting chamber 2 to avoid an entrainment or passing over of impurities from the melt sludge into the holding chamber 4. In the preferred embodiment the passage is approximately 150 mm above the bottom 14. The gap 3 is sufficiently large to achieve a low flow velocity of the melt passing through it with a given maximum throughput of the magnesium melting furnace 1. In a furnace with a throughput of approx. 1 tonne per hour, the size of the gap 3 is approx. 50 mm×500 mm.

A sink 22 can optionally be arranged downstream of the passage 3 in the holding chamber 4, said sink 22 being gassed with a protective gas ($N_2$ with 0.2 to 0.5% of $SF_6$). The escaping protective gas rises in the holding chamber to the surface entraining impurities.

An overflow weir 23 is arranged in the middle of the holding chamber 4 between the first dividing wall and the second dividing wall 12. The height of the overflow weir is approximately 50% to 80%, preferably 70% of the height of the melt. The installation of said overflow weir 23 prevents inter alia the melt entering through the first passage 3 from flowing straight to the second passage 5 and thus having too short a residence period in the holding chamber. This improves the purification of the melt in the holding chamber 4.

While the melt is flowing through the holding chamber 4, some of the impurities, in particular heavy metal-containing melt sludges, sink to the bottom 15 of the chamber 4. Other impurities rise to the surface of the melt and form a layer there (dross).

The melt purified in the holding chamber 4 enters the metering chamber 6 through the second passage 5 located in the second dividing wall 12. Just like the first passage 3, the second passage 5 is arranged at a short distance above the bottom 15 to allow as pure a melt as possible to pass therethrough. In order to avoid an entrainment of the impurities which have sunk to the bottom 15 of the holding chamber 4, the lower edge of the second passage 5 is arranged above the maximum height of the layer of impurities setting on the bottom 15 of the holding chamber 4. In the preferred embodiment according to FIG. 1, the second passage 5 is designed, like the first passage 3, as a horizontal gap. The second passage is located roughly 100 mm above the bottom 15.

Furthermore, a weir 24 protruding horizontally into the second chamber 4 and improving the flow conditions during the passing over of the melt into the third chamber 6 is located on the upper edge of the second passage 5.

A ceramic filter 25 can be arranged in the metering chamber 6 immediately downstream of the second passage 5. The ceramic filter 25 serves to further purify the melt entering the metering chamber 6.

A metering pump 27 is arranged in the metering chamber 6 upstream of the removal point for the molten and purified magnesium. Said metering pump 27 raises the molten magnesium to be removed above the melt surface and transports the melt into a transfer pipe 28. The transfer pipe 28 is passed outside from the side under the cover insulation 29. To make sure that the molten magnesium flows out, the transfer pipe 28 is inclined at a slight angle downwards. The part of the transfer pipe 28 protruding through the jacket 13 is provided with a heating means 30, for example an electrical heating means. The magnesium melt removed is passed to a diecasting machine or a transport container.

In order to avoid oxidation of the removed melt in the transfer pipe 28, the transfer pipe is filled in the preferred embodiment with a protective gas. The protective gas is passed through the transfer pipe 28, pulse gassing being provided to save protective gas.

The spaces above the melt surface in the three chambers 2, 4 and 6 are filled With protective gas to avoid oxidation. In the preferred embodiment the dividing walls 11 and 12 reach to the cover insulation 29 in order to achieve separation of the spaces filled with protective gas. The protective gas is fed in through a system 31 of pipes and valves. The valves are controlled so that the compositions of the protective gas atmospheres above the three chambers can be set separately. Thus it is possible to graduate the amount of protective gas supplied so that a protective gas atmosphere with a higher $SF_6$ content can be fed in the space above the melt in the melting chamber 2 and a protective gas atmosphere with a lower $SF_6$ content in the spaces above the melt in the holding chamber 4 and the metering chamber 6. In the preferred embodiment the $SF_6$ content is approx. 0.5% above the melt in the melting chamber 2 and approx. 0.2 to 0.3% above the melt in the holding chamber 4 and the metering chamber 6. Thanks to this graduated protective gas atmosphere it is possible to save $SF_6$; furthermore, the corrosion caused by $SF_6$ in the holding chamber and in the metering chamber is reduced.

Moreover, it is possible to pass protective gas through the charging chute 20 and the transfer pipe 28 through the system 31 of pipes and valves. In normal operation i.e. when the covers are closed, the spaces above the melt in the chambers are supplied with gas through the valves 33. If the covers over the respective chambers are opened to clean the melting bath surface, the sudden increase in protective gas requirements is covered by the automatic opening of by-pass valves 34. When opened, the by-pass valves 34 supply roughly five to ten times more protective gas at the same gas pressure than the valves 33. The advantage of using the by-pass valve arrangement instead of controlling a single valve is that it is possible to react quickly to a sudden increase in demand.

The holding chamber 4 exhibits an additional duct 32 through which the material for re-alloying the molten magnesium can be introduced. The material brought into the holding chamber 4 through said duct 32 is relatively pure, so that no further impurities are produced in the holding chamber. Just like the charging duct 32, the additional duct 31 also terminates under the melting bath surface to avoid the entraining of any impurities from the melting bath surface and turbulences when the parts to be melted are introduced. Furthermore, the additional duct 32 can be filled with protective gas through the system 31 of pipes and valves.

Figure 2:
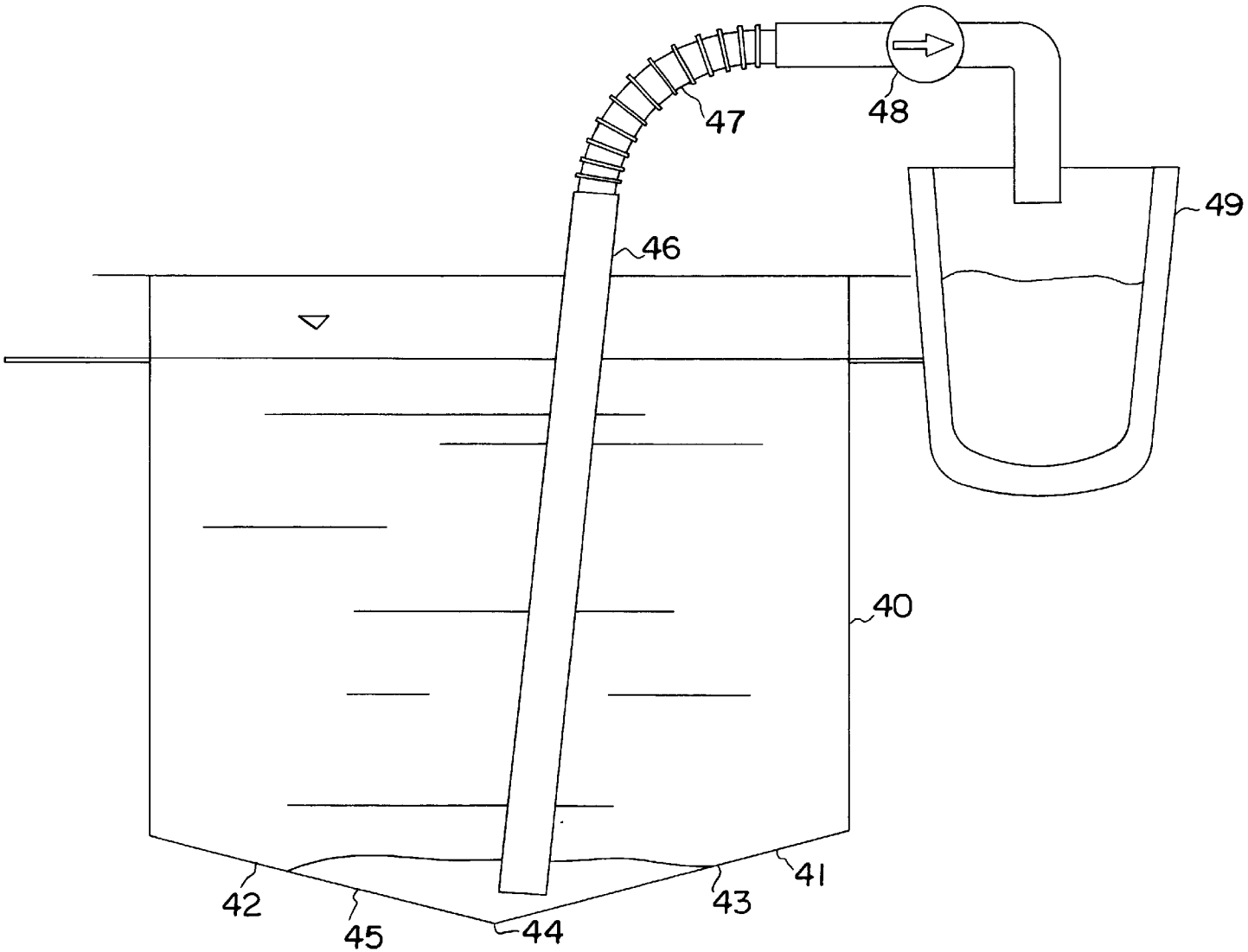
FIG. 2 is a device for extracting by suction the melt sludges from a channel located at the bottom of a chamber.

FIG. 2 shows a device for extracting the impurities 45 settling on the bottom 41 of a chamber 40. FIG. 2 shows a cross-section, vertical to the plane in accordance with FIG. 1, through the melting chamber 2 or the holding chamber 4 in the following generally referred to as chamber 40.

The floor 41 of the chamber 40 exhibits inclined surfaces 42 and 43 which are arranged so that a channel 44 is formed in the middle of the chamber 40 as the lowest point. Melt sludges 45 collect in said channel 44.

A pipe 46 protrudes from above into the chamber 40 and into the melt, the pipe 46 terminating in the immediate vicinity of the channel 44 in the melt sludge 45. A line 47, which leads to a suction pump 48, is mounted on the top end of the pipe 46. The melt sludge 45 is extracted from the bottom 41 of the chamber 40 with the aid of the suction pump 48 and conveyed into a container 49.

Figure 3:
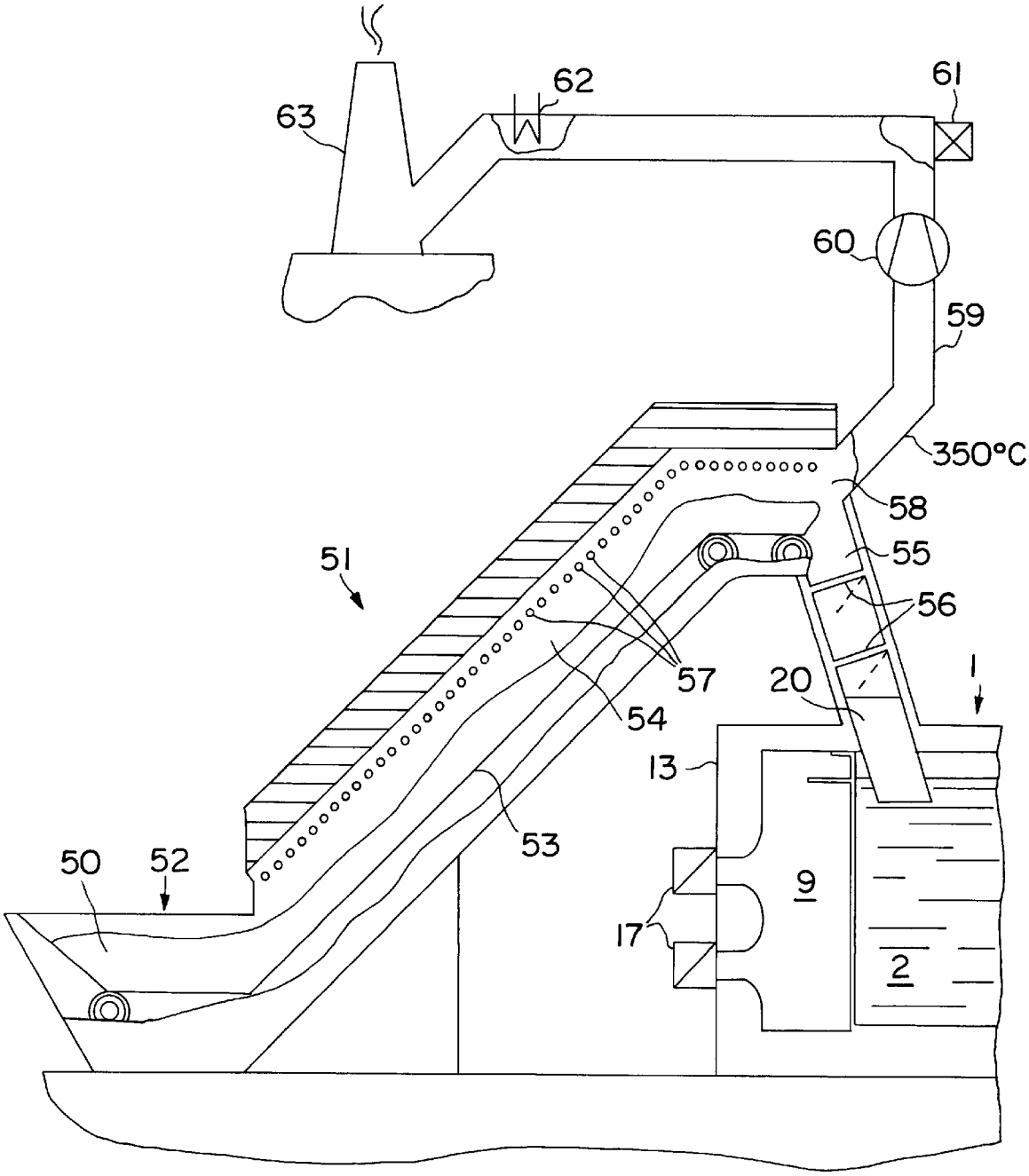
FIG. 3 is an embodiment of a device for feeding the material to be melted with burn-off device and charging chute.

FIG. 3 shows a device for feeding the material to be melted into the magnesium melting furnace 1.

The starting material 50, which contains both relatively pure magnesium raw material in the form of pigs and works scrap as well as old scrap contaminated with oil and other impurities is fed into a burn-off device 51 via a feed orifice 52. A transport device 53 with a slowly moving conveyor belt transports the material through a duct 54 enclosed on all sides and running upwards at an angle to the upper orifice 55 of the charging duct 20 provided with locks 56. Whilst in the duct 54 leading upwards, the material lying on the transport device 53 is heated with the aid of a heating means 57 radiating heat from above onto the material. During the heating to approx. 450° C. some of the contaminants (oily impurities) burn off and/or evaporate. The burned-off or evaporating impurities form a burned-off gas which rises in the duct 54 and enters a discharge duct 59 at the top end 58 of the duct 54. The heated magnesium to be melted falls at the end 58 of the duct 54 from the transport device 53 into the charging duct 20 provided with locks 56 and from there into the melting bath.

The discharge duct 59 exhibits a blower 60 to extract the burned-off gases. In the embodiment in accordance with FIG. 3 the extracted burned-off gases are post-combusted by a burner 61. The hot waste gases pass via a heat exchanger 62 to a stack 63. The thermal energy recovered in the heat exchanger can be used to heat the combustion air for the burners 17.

The amount of material to be melted fed into the magnesium melting furnace 1 is controlled via the drive of the transport device 53. The feed of the material to be melted is controlled as a function of the weight of the melting furnace 1. The magnesium melting furnace is rotatably mounted on one edge of the bottom of the jacket 13. A bearing provided with a load cell is provided on the opposite edge. The load measured with the aid of this load cell is converted into a weight of the magnesium melting furnace 1. The necessary amount of material to be fed into the furnace is determined by the weight difference calculated as a function of time. By keeping the weight of the magnesium melting furnace constant it is ensured that the filling level of the melt in the furnace chambers remains more or less constant. This ensures constant immersion of the bottom end of the charging duct 20 below the melt surface. Furthermore, the flow conditions in the furnace are also kept more or less constant.

We claim:

1. A magnesium melting furnace comprising:

a first chamber to accommodate a melt, said first chamber defined by a first bottom, and a plurality of first walls including a first dividing wall;

a feeding device to feed a magnesium material into said first chamber;

a second chamber adjacent to said first dividing wall defined by a second bottom, and a plurality of second walls including a second dividing wall and said first dividing wall;

said first dividing wall being provided between said first chamber and said second chamber, said first dividing wall comprising at least one first passage, said first passage arranged in the lower third of said first dividing wall such that a lower limit of said passage being at a height above said first bottom which is higher than a maximum height of a first layer of impurities settling on said first bottom; and at least one second passage arranged in the bottom third of said second dividing wall through which the melt can flow out of said second chamber.

2. The magnesium melting furnace according to claims 1, further comprising a third chamber, adjacent to said second dividing wall defined by a third bottom and a plurality of third walls including said second dividing wall;

a portion of said second dividing wall separates said second chamber from said third chamber.

3. The magnesium melting furnace according to claim 2, further comprising a removal device coupled to said third chamber, to remove molten magnesium.

4. The magnesium melting furnace according to claim 1, wherein said first passage is a gap stretching essentially over the entire width of said first dividing wall.

5. The magnesium melting furnace according to claim 2, wherein said first bottom and said second bottom exhibit essentially rectangular areas, wherein said first dividing wall and said second dividing wall are arranged on opposite sides of said second bottom, in one plane and parallel to each other.

6. The magnesium melting furnace according to claim 5, further comprising a middle wall ending with said second bottom and said second walls, said middle wall arranged essentially in the middle of said second chamber between and parallel to said first dividing wall and said second dividing wall, said middle wall having a height being greater than half the height of said first and second dividing walls.

7. The magnesium melting furnace according to claim 2, wherein said second passage is arranged at a height above said second bottom which is greater than the maximum height of a second layer of impurities settling on said second bottom.

8. The magnesium melting furnace according to claim 7, wherein said second passage is a gap stretching essentially over the entire width of said second dividing wall.

9. The magnesium melting furnace of claim 8, further comprising a weir protruding horizontally into said second chamber, said weir arranged on the upper edge of said gap forming said second passage in said second dividing wall.

10. The magnesium melting furnace according to claim 1, wherein said first and second bottoms exhibit inclined surfaces which are arranged in such a manner that a first channel and a second channel are formed in said first and second bottoms, respectively, at the lowest point of said channels sinking impurities in the fluid can collect.

11. The magnesium melting furnace according to claim 10, wherein a first suction device and a second suction device are arranged in relation to said first and second chamber, respectively, so that the sinking impurities can be extracted by suction from said first and second channels, respectively.

12. The magnesium melting furnace according to claim 1, wherein said first chamber and said second chamber are isolated from each other by means of said first dividing wall so that both chambers can be filled with different protective gas compositions and concentrations in the spaces above the fluid.

13. The magnesium melting furnace according to claim 1, wherein said first and said second walls are comprised of steel.

14. The magnesium melting furnace according to claim 13, further comprising burners to heat the chambers, said burners arranged on outer walls of said first and said second walls.

15. The magnesium melting furnace according to claim 3, wherein a metering pump is coupled to said removal device.

16. The magnesium melting furnace according to claim 15, wherein said metering pump is coupled with a transfer pipe through which a fluid transported by said metering pump is removed from the side under a cover insulation of said third chamber.

17. The magnesium melting furnace according to claim 1, wherein said feeding device exhibits a charging duct, wherein one end of said charging duct terminates under a melt surface in said first chamber.

18. The magnesium melting furnace according to claim 1, wherein said feeding device exhibits a charging device which is coupled with a measuring device to measure the weight of said magnesium melting furnace so that a magnesium material to be melted is fed into said magnesium melting furnace as a function of furnace weight.

19. The magnesium melting furnace according to claim 1, wherein said feeding device exhibits a burn-off device which is arranged in such a manner that a material to be fed into said first chamber can be thermally pre-treated when passing through said burn-off device.

20. A method for melting magnesium in a magnesium furnace comprising a first chamber, a second chamber adjacent to said first chamber, and a third chamber, adjacent to said second chamber, the method comprising the steps of:

a) feeding magnesium material to be melted into said first chamber;

b) melting said magnesium material in said first chamber, thereby forming a melt in said first chamber;

c) transferring said melt into said second chamber via a first passage with a flow velocity of less than 0.1 m/sec, said first passage starting in the lower third of a sidewall of said first chamber;

d) retaining said melt in said second chamber whilst flowing slowly, whereby impurities are settling or raising to the surface of said melt, thereby purifying said melt;

e) transferring said purified melt into said third chamber via a second passage with a flow velocity of less than 0.05 m/sec; and f) removing said purified melt from said third chamber for further processing.

21. The method of claim 20, further comprising the step of thermally pre-treating the magnesium material to be melted in a burn-off device before being fed into said first chamber.

22. The method according to claim 21, wherein in the step of thermally pre-treating the material to be melted is heated to a temperature of approx. 300° C. to 450° C.

23. The method according to claim 21 or 22, wherein in the step of thermally pre-treating the material, gases formed in the burn-off device are collected and post-combusted, wherein the heat generated in said post-combusting step heats the material to be melted in the burn-off device or melts the magnesium material in said first chamber.

24. The method according to claim 20, further comprising the steps of determining the weight of said magnesium melting furnace, wherein the material to be melted is fed into said first chamber as a function of the furnace weight so that the furnace weight remains constant.

* * * * *

UNITED STATES PATENT AND TRADEMARK OFFICE

CERTIFICATE OF CORRECTION

PATENT NO. : 5,908,488

DATED : June 1, 1999

INVENTOR(S) : Schröder

It is certified that error appears in the above-identified patent and that said Letters Patent is hereby corrected as shown below:

On the title page: Item [73] Assignee:

Please delete assignee name "Rauch Fertigungstechnik Ges. m.h.H." and insert -- Rauch Fertigungstechnik Ges. m.b.H. --

Please delete the German application number "44 39 214" under the Foreign Application Priority Data, and insert -- P 44 39 214.1 --

Signed and Sealed this

Seventeenth Day of April, 2001

*Attest:*

Nicholas P. Godici

NICHOLAS P. GODICI

*Attesting Officer*

*Acting Director of the United States Patent and Trademark Office*